United States Patent [19]

Tsujino et al.

[11] 4,094,683

[45] June 13, 1978

[54] DIRECT POSITIVE SILVER HALIDE PHOTOGRAPHIC MATERIALS

[75] Inventors: Nobuyuki Tsujino; Akira Ogawa; Tadao Shishido; Keiichi Adachi, all of Minami-ashigara, Japan

[73] Assignee: Fuji Photo Film Co., Ltd., Minami-ashigara, Japan

[21] Appl. No.: 700,365

[22] Filed: Jun. 28, 1976

[30] Foreign Application Priority Data

Jun. 27, 1975 Japan ..... 50-79893

[51] Int. Cl.[2] ..... G03C 5/24; G03C 1/06; G03C 1/28

[52] U.S. Cl. ..... 96/95; 96/64; 96/107

[58] Field of Search ..... 96/64, 95, 109, 107

[56] References Cited

U.S. PATENT DOCUMENTS

| | | | |
|---|---|---|---|
| 3,384,484 | 5/1968 | Schranz et al. | 96/64 |
| 3,525,622 | 8/1970 | Willems et al. | 96/109 |
| 3,615,615 | 10/1971 | Lincoln et al. | 96/64 |
| 3,718,470 | 2/1973 | Spence et al. | 96/64 |

*Primary Examiner*—Mary F. Kelley
*Attorney, Agent, or Firm*—Sughrue, Rothwell, Mion, Zinn and Macpeak

[57] ABSTRACT

A direct positive silver halide light-sensitive material capable of forming direct positive images comprising a support having coated thereon at least one internal image type silver halide emulsion layer, wherein at least one hydrophilic colloid layer contains a heterocyclic quaternary salt compound represented by formula (I) in an amount necessary to provide the silver halide photographic emulsion with a fogging function.

(I)

wherein Z is an atomic group necessary for completing a 5- or 6-membered heterocyclic nucleus, $R_1$ is an aliphatic group, $R_2$ is a hydrazonoalkyl group, $X\ominus$ is an anion, and n is 1 or 2.

11 Claims, No Drawings

DIRECT POSITIVE SILVER HALIDE PHOTOGRAPHIC MATERIALS

BACKGROUND OF THE INVENTION

1. Field of the Invention

The present invention relates to a silver halide photographic light-sensitive material which forms direct positive photographic images, more particularly, to a photographic light-sensitive material having a photographic emulsion layer or a hydrophilic colloid layer containing a novel compound as a fogging agent.

2. Description of the Prior Art

In the field of silver halide photographic methods, a photographic method where photographic images can be obtained without forming negative images or without carrying out any intermediate processings for forming negative images is called a direct positive photographic method, and the photographic light-sensitive materials and the photographic emulsions that are employed in such a photographic method are called direct positive light-sensitive materials and direct positive photographic emulsions, respectively.

There are various types of direct positive photographic methods. Among these methods, a more useful method is one which comprises exposing fogged silver halide grains in the presence of a desensitizer and then developing the same, or one which comprises exposing a silver halide emulsion predominantly containing silver halide grains having light-sensitive nuclei inside the grains and then developing the same in the presence of a fogging agent. This invention belongs to the latter method.

A silver halide emulsion containing silver halide grains predominantly having light-sensitive nuclei inside the grains which are capable of forming latent images inside grains is called an internal latent image type silver halide emulsion.

Methods for obtaining direct positive images by the surface development of an internal latent image type silver halide photographic emulsion in the presence of a fogging agent, and a photographic emulsion or light-sensitive material employed in such methods are disclosed in U.S. Pat. Nos. 2,456,953, 2,497,875, 2,497,876, 2,588,982, 2,592,250, 2,675,318 and 2,675,318, British Pat. Nos. 1,011,062 and 1,151,363, and in Japanese patent publication No. 29,405/68.

In the above-mentioned methods for obtaining direct positive images, a fogging agent can be added to a developing solution, but more preferably is added to a photographic emulsion layer or another layer of a light-sensitive material to adsorb it to the surface of the silver halide grains because better reversal photographic properites are obtained.

As the fogging agents which are added to a silver halide emulsion layer or another layer of a light-sensitive material, hydrazine compounds are known as disclosed in U.S. Pat. Nos. 2,563,785 and 2,588,982. However, where hydrazine compounds are added to a silver halide emulsion layer, a high concentration thereof (e.g. about 2 g per 1 mol of silver) is necessary, and the concentration thereof in the emulsion layer changes because they are dissolved out from the emulsion layer into a developing solution in development, whereby maximum density (unexposed areas) becomes irregular, and, in a multilayer light-sensitive color photographic material, the fogging effects between the emulsion layers become unbalanced.

In order to avoid these defects, it was proposed in U.S. Pat. Nos. 3,615,615, 3,719,494, 3,734,738 and 3,759,901 that a heterocyclic quaternary salt compound be used as a fogging agent. However, there are many cases where a spectral sensitizing dye is added to the silver halide emulsion for spectral sensitization. Particularly, color light-sensitive materials must have layers sensitive to green light and red light together with a blue-sensitive layer, and so the green-sensitive and red-sensitive emulsion layers always contain spectral sensitizing dyes.

Where fogging agents are present together with spectral sensitizing dyes for green light and red light in the direct positive emulsion, competitive adsorption to the silver halide emulsion takes place between the spectral sensitizing dyes and the quaternary salt fogging agent. Therefore, if the fogging agents are added in an amount necessary to form the desired nuclei, the spectral sensitization effects are prevented, and if the spectral sensitizing dyes, on the other hand, are added in the concentration necessary to obtain the desired spectral sensitization, the formation of fogging nuclei is prevented as well.

In order to overcome this difficult problem, it is known from U.S. Pat. No. 3,718,470 that spectral sensitizing dyes having nucleating substituent groups in the dye molecules can be employed.

However, according to the method in which both a fogging function and a spectral sensitizing function are provided to one molecule, there are defects that if the material is used in an amount necessary for spectral sensitization, a sufficient fogging effect cannot be obtained, while if the material is used in an amount necessary for fogging, insufficient spectral sensitization is obtained.

To overcome the above defect, there are needed fogging agents which can easily be adsorbed onto silver halide grains and form desired nuclei in such an amount as not to prevent a spectral sensitizing effect.

SUMMARY OF THE INVENTION

A first object of this invention is to provide a direct positive light-sensitive material capable of yielding an image of uniform maximum density.

A second object of the invention is to provide a direct positive light-sensitive material containing a fogging agent which can provide desired a fogging effect without preventing spectral sensitization.

A further object of the invention is to provide a direct positive light-sensitive material which can be sufficiently spectrally sensitized and can form direct positive images having a uniform, high maximum density.

A still further object of the invention is to provide a direct positive light-sensitive material which does not contaminate a developing solution.

The above objects of the invention are attained by incorporating into at least one hydrophilic colloid layer, preferably an internal latent image type silver halide photographic emulsion layer of a silver halide light-sensitive material or a hydrophilic colloid layer adjacent to such an emulsion layer, a heterocyclic quaternary salt compound represented by formula (I) in an amount sufficient to provide the silver halide photographic emulsion with a fogging function.

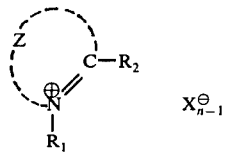

(I)

wherein Z is an atomic group necessary for completing a 5- or 6-membered heterocyclic nucleus, $R_1$ is an aliphatic group, $R_2$ is a hydrazonoalkyl group, $X^{\ominus}$ is an anion, and $n$ is 1 or 2.

DETAILED DESCRIPTION OF THE INVENTION

The heterocyclic nucleus represented by Z includes, for example, a thiazole nucleus, benzothiazole nucleus, naphthothiazole nucleus, selenazole nucleus, benzoselenazole nucleus, naphthoselenazole nucleus, oxazole nucleus, benzoxazole nucleus, naphthoxazole nucleus, benzimidazole nucleus, pyridine nucleus, quinoline nucleus, indolenine nucleus, etc. As more specific examples of these nuclei, there are thiazoles, e.g., thiazole, 4-methylthiazole, 4-phenylthiazole, 4-(p-hydroxyphenyl)thiazole, 5-methylthiazole, 5-phenylthiazole, 4,5-dimethylthiazole, 4,5-diphenylthiazole, etc.; benzothiazoles, e.g. benzothiazole, 5-hydroxybenzothiazole, 5-fluorobenzothiazole, 4-chlorobenzothiazole, 5-chlorobenzothiazole, 6-chlorobenzothiazole, 7-chlorobenzothiazole, 7-methylbenzothiazole, 5-methylbenzothiazole, 6-methylbenzothiazole, 5,6-dimethylbenzothiazole, 5-bromobenzothiazole, 6-bromobenzothiazole, 5-phenylbenzothiazole, 6-phenylbenzothiazole, 7-phenylbenzothiazole, 4-methoxybenzothiazole, 5-methoxybenzothiazole, 6-methoxybenzothiazole, 7-methoxybenzothiazole, 5-iodobenzothiazole, 6-iodobenzothiazole, 5-ethoxybenzothiazole, 6-ethoxybenzothiazole, tetrahydroxybenzothiazole, 5-(N,N-dimethylamido)benzothiazole, 5,6-dimethoxybenzothiazole, 5-hydroxybenzothiazole, 6-hydroxybenzothiazole, etc.; naphthothiazoles, e.g., α-napththiazole, β-napthothiazole, β,β-naphthothiazole, 5-methoxy-β-naphthothiazole, 5-ethoxy-β-napththothiazole, 7-methoxy-α-naphthothiazole, 5-hydroxy-β-naphthothiazole, 7-hydroxy-α-naphthothiazole, 5-ethyl-β-naphthothiazole, etc.; selenazoles, e.g., selenazole, 4-methylselenazole, 4-phenylselenazole, etc; benzoselenazoles, e.g., benzoselenazole, 5-chlorobenzoselenazole, 5-methoxybenzoselenazole, 5-hydroxybenzoselenazole, tetrahydroxybenzoselenazole, etc.; naphthoselenazoles, e.g., α-naphthoselenazole, β,β-naphthoselenazole, β-naphthoselenazole, etc.; oxazoles, e.g., oxazole, 4-methyloxazole, 5-methyloxazole, 4-phenyloxazole, 4,5-diphenyloxazole, 4-ethyloxazole, 4,5-dimethyloxazole, 5-phenyloxazole, etc.; benzoxazoles, e.g., benzoxazole, 5-chlorobenzoxazole, 5-methylbenzoxazole, 5-phenylbenzoxazole, 6-methylbenzoxazole, 5,6-dimethylbenzoxazole, 5-methoxybenzoxazole, 5-ethoxybenzoxazole, 6-chlorobenzoxazole, 6-methoxybenzoxazole, 5-trifluoromethylbenzoxazole, 5-hydroxybenzoxazole, 6-hydroxybenzoxazole, etc.; naphthoxazoles, e.g., α-naphtoxazole, β,β-naphthoxazole, β-naphthoxazole, 7-hydroxy-β-naphthoxazole, etc.; benzimidazoles, e.g., 1-ethylbenzimidazole, 1-ethyl-5,6-dichlorobenzimidazole, 1-phenyl-5,6-dichlorobenzimidazole, etc.; pyridines, e.g., pyridine, 3-ethylpyridine, 4-decylpyridine, 4-octadecylpyridine, 4,6-dibutylpyridine, 4-benzylpyridine, 4-phenylpyridine, 4,6-diphenylpyridine, 4,6-dinaphthylpyridine, 4-chloropyridine, 4-bromopyridine, 4,6-dichloropyridine, 4-chloropyridine, 6-bromopyridine, 4-methoxypyridine, 4-ethoxypyridine, 6-methoxypyridine, 6-ethoxypyridine, 4,6-dimethoxypyridine, etc.; quinolines, e.g., quinoline, 3-methylquinoline, 6-methylquinoline, 8-methylquinoline, 6-chloroquinoline, 8-chloroquinoline, 8-fluoroquinoline, 6-methoxyquinoline, 6-ethoxyquinoline, 6-hydroxyquinoline, 8-hydroxyquinoline, etc.; and indolenines, e.g., indolenine, 3,3-dimethylindolenine, 5-hydroxy-3,3-dimethylindolenine, 3,3-dimethyl-6-chloroindolenine, 3,3,5-trimethylindolenine, etc.

In the formula, $R_1$ is an aliphatic group, preferably with 1 to 8 carbon atoms, such as an unsubstituted alkyl group (e.g., having 1 to 8 carbon atoms, such as methyl group, ethyl group, propyl group or butyl group), a substituted alkyl group [preferably having an alkyl moiety of 1 to 4 carbon atoms, for example, a sulfo substituted alkyl group {e.g., a sulfoalkyl group (e.g. β-sulfoethyl group, γ-sulfopropyl group, γ-sulfobutyl group, δ-sulfobutyl group, etc.), a sulfoalkoxyalkyl group (e.g., sulfoethoxyethyl group, sulfopropoxyethoxyethyl group, etc.), a hydroxysulfoalkyl group (e.g., 2-hydroxy-3-sulfopropyl group, etc.), etc.], a carboxyalkyl group (e.g., β-carboxyethyl group, ω-carboxybutyl group, carboxymethyl group, etc.), a hydroxyalkyl group (e.g., β-hydroxyethyl group, γ-hydroxypropyl group, etc.), an alkoxyalkyl group, where the alkoxy moiety preferably has from 1 to 4 carbon atoms, which may be substituted (preferably with a hydroxy group or an acetoxy group, e.g., β-methoxyethyl group, γ-methoxypropyl group, hydroxymethoxymethyl group, 2-hydroxyethoxymethyl group, 2-(2-hydroxyethoxy)ethyl group, 2-(2-acetoxyethoxy)ethyl group, acetoxymethoxymethyl group, etc.), an acyloxyalkyl group (e.g., β-acetoxyethyl group, ω-propionyloxybutyl group, etc.), a dialkylaminoalkyl group (where preferred alkyl moieties have from 1 to 4 carbon atoms e.g., dimethylaminoethyl group, diethylaminopropyl group, etc.), a sulfatoalkyl group (e.g., β-sulfatoethyl group, ω-sulfatobutyl group, etc.), an aralkyl group (e.g., benzyl group, phenethyl group, p-sulfobenzyl group, etc.), a vinylmethyl group, etc.

$R_2$ is a hydrazonoalkyl group in which the alkyl moiety preferably has 1 to 8 carbon atoms and which may have a substituent on the nitrogen atom thereof. One class of hydrozonoalkyl groups especially useful in the invention is represented by formula (Ia), $$\{L\}_k L_1 = N - NH - R \qquad \text{(Ia)}$$

wherein L is an alkyl group having 1 to 7 carbon atoms which may be branched, $L_1$ is a methine group which may be substituted with an alkyl group having 1 to 4 carbon atoms, an unsubstituted aryl group (e.g. phenyl group) or a substituted aryl group (e.g. a phenyl group substituted with an alkyl group having 1 to 3 carbon atoms, an alkoxy group having 1 to 3 carbon atoms, a halogen atom or a carboxy group), and $k$ is 0 or 1.

R is an unsubstituted aryl group (preferably a mono- or bicyclic aryl group. e.g., a phenyl group, naphthyl group, etc.), a substituted aryl group (preferably a substituted mono- or byclic aryl group, e.g. a phenyl or naphthyl group substituted with a halogen atom, an alkyl group, preferably with from 1 to 4 carbon atoms, a hydroxy group, an alkoxy group, preferably with from 1 to 4 carbon atoms, an aryloxy group, most preferably a phenyloxy group, an amino group, an acylamino group, a carbamoyl group, a carboxy group or a sulfo group), an aralkyl group (most preferably comprising an alkyl moiety of 1 to 4 carbon atoms, and wherein the aryl moiety includes phenyl and phenyl substitued with an alkyl group having 1 to 4 carbon atoms, an alkoxy group having 1 to 4 carbon atoms, a halogen atom such as chlorine, bromine, fluorine and the like, e.g., a benzyl group, phenethyl group, etc.), a 2-benzothiazolyl group, a quinolyl group, a pyridyl group, a carbamoyl group, a substituted carbamoyl group (e.g. phenylcarbamoyl group, methylcarbamoyl group, etc.), a thiocarbamoyl group or a substituted thiocarbamoyl group (e.g. methylthioxarbamoyl group, phenylthiocarbamoyl group, etc.).

As the typical specific examples of the hydrazono moiety, there are a phenylhydrazono moiety, p-chlorophenylhydrazono moiety, p-tolylhydrazono moiety, p-methoxyphenylhydrazono moiety, p-carboxyphenylhydrazono moiety, p-sulfophenylhydrazono moiety, p-nitrophenylhydrazono moiety, m-tolylhydrazono moiety, 2-benzothiazolylhydrazono moiety, 3-quinolylhydrazono moiety, N-phenylcarbamoylhydrazono moiety, etc.

$R_1$ and $R_2$ can form a 5- or 6-membered ring by fusing carbon atoms at each of their $\alpha$-positions.

As typical examples of $X^{\ominus}$, there are a chloride ion, bromide ion, iodide ion, p-toluene sulfonate ion, ethyl sulfonate ion, perchlorate ion, etc.

In formula (I), $n$ is 1 when the compound forms an intermolecular salt or 2 where it does not form the intermolecular salt.

In this invention, more preferred heterocyclic quaternary salts are represented by formula (II).

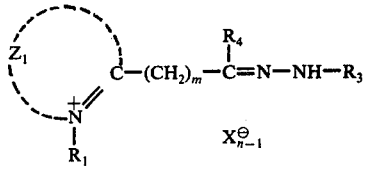

wherein $Z_1$ is an atomic group necessary for completing a benzothiazole nucleus, a benzoselenazole nucleus, a benzoxazole nucleus or a pyridine nucleus, $R_3$ is an unsubstituted or substituted aryl group (preferably a mono- or bicyclic aryl group, e.g., a phenyl group or naphthyl group which be substituted with a halogen atom, a lower alkyl group having up to 4 carbon atoms, an alkoxy group of which alkyl moiety may have 1 to 4 carbon atoms, a hydroxy group, a sulfo group or a carboxy group as a substituent) or an aralkyl group (most preferably an aralkyl group having an alkyl moiety of 1 or 2 carbon atoms, where the aryl moiety includes phenyl and substituted phenyl group, for example, substituted with an alkyl group of 1 or 2 carbon atoms, an alkoxy group of 1 or 2 carbon atoms or a halogen atom such as chlorine, bromine, and the like. e.g., a benzyl group), $R_4$ is a lower alkyl group having up to 4 carbon atoms or an aryl group (e.g., a phenyl group, p-tolyl group, p-methoxyphenyl group, 3,5-dichlorophenyl group, o-carboxyphenyl group, etc.), $m$ is 1 to 4 and $R_1$, $X^{\ominus}$ and $n$ each have the same meanings as in formula (I).

The most preferred heterocyclic quaternary salts in the invention are represented by formula (III),

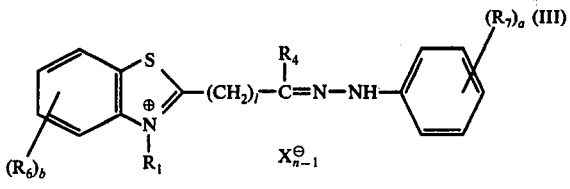

wherein $R_6$ is a halogen atom (e.g., a chlorine atom or bromine atom), a lower alkyl group having 1 to 4 carbon atoms (e.g., a methyl group or ethyl group), an alkoxy group having an alkyl moiety of 1 to 4 carbon atoms (e.g., a methoxy group or ethoxy group), a hydroxy group, a carboxy group or an aryl group (e.g., a phenyl group), $R_7$ is a lower alkyl group having 1 to 4 carbon atoms (e.g., a methyl group, ethyl group or propyl group), a halogen atom (e.g., a chlorine atom or bromine atom), an alkoxy group having alkyl moiety of 1 to 4 carbon atoms (e.g., a methoxy group or ethoxy group), a hydroxy group, a sulfo group or a carboxy group, $a$ and $b$ each is 0, 1, 2 or 3 (when $a$ is 2 or 3, two or three of $R_7$ may be same or different, and when $b$ is 2 or 3, two or three of $R_6$ may be same or different), $l$ is 2 or 3 and $R_1$, $R_4$, $X^{\ominus}$ and $n$ each has the same meaning as in formula (II).

Useful heterocyclic quaternary salts of the invention include the following compounds, but should not be limited to these examples.

1.

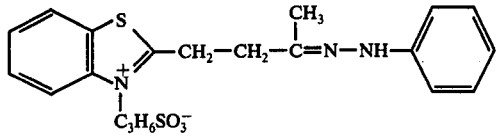

2.

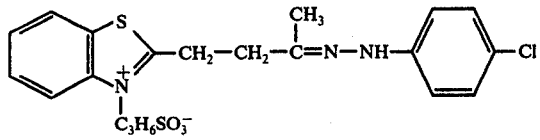

3.

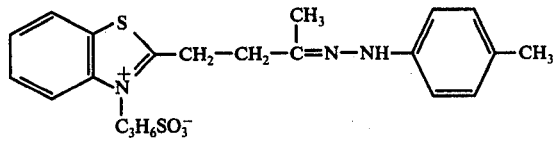

4.
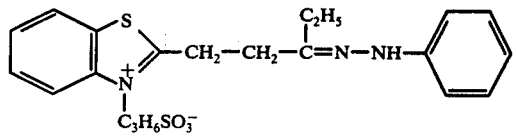
5.
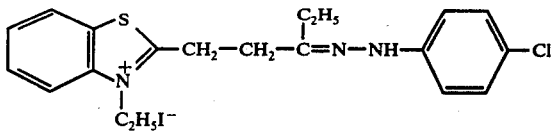
6.
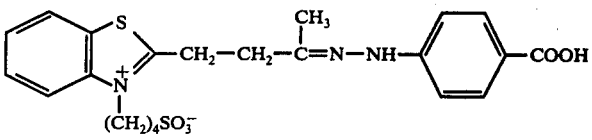
7.
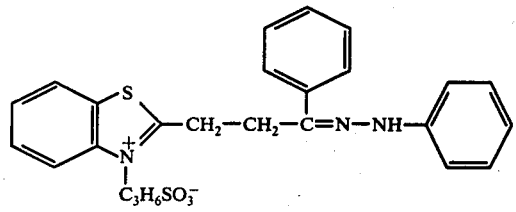
8.
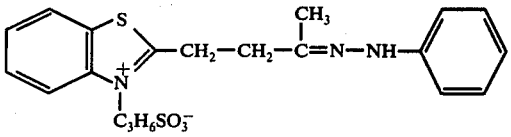
9.
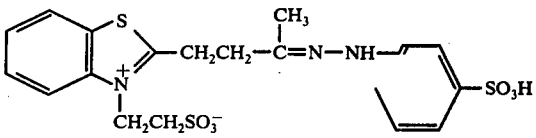
10.
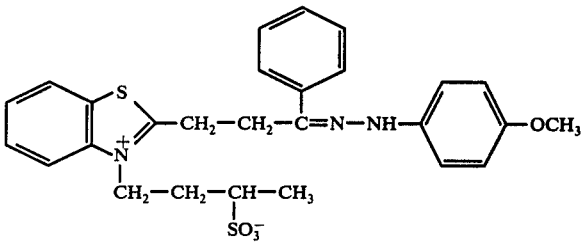
11.
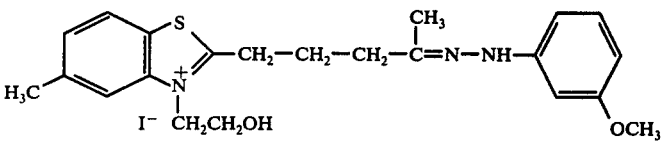
12.
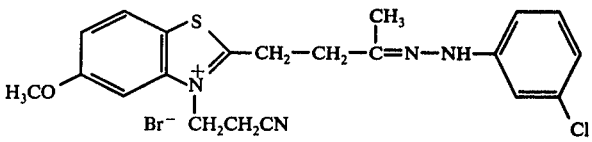

-continued
13.
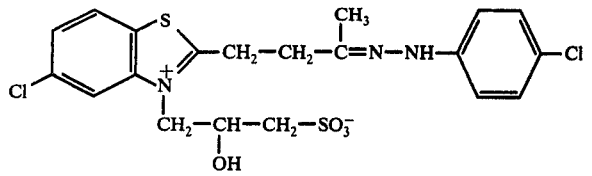
14.
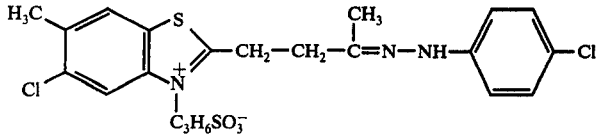
15.
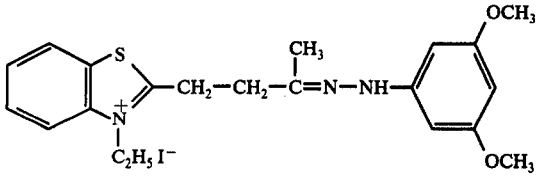
16.
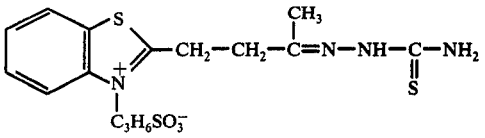
17.
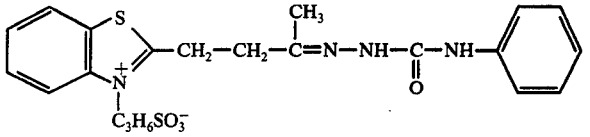
18.
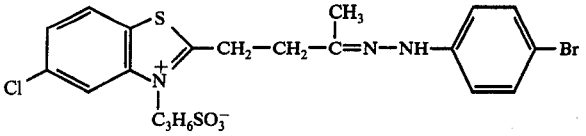
19.
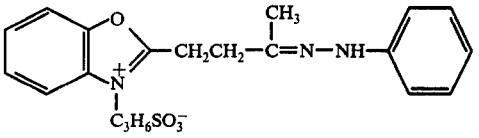
20.
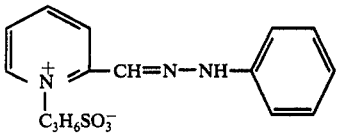
21.
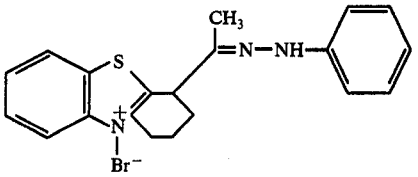
22.
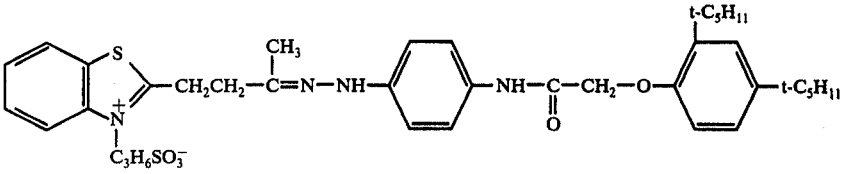
Heterocyclic quaternary salts of the invention can be easily synthesized by preparing a quaternary salt com-

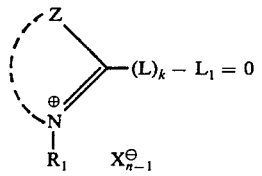

(IV)

wherein Z, $R_1$, $X^{\ominus}$ and $n$ each has the same meaning as in formula (I), and L, $L_1$ and $k$ each has the same meaning as in formula (Ia).

Typical examples of the hydrazine compounds include phenylhydrazine, p-tolylhydrazine, p-sulfophenylhydrazine, p-chlorophenylhydrazine, p-methoxyphenylhydrazine, p-carboxyphenylhydrazine, p-nitrophenylhydrazine, thiosemicarbazide, N-phenylcarbamoylhydrazine, p-bromophenylhydrazine, m-methoxyphenylhydrazine, etc.

This reaction does not need a catalyst in general and proceeds under mild conditions at about 20° C to 30° C. The reaction is conveniently preformed at atmospheric pressure over a period of from about 20 to about 120 minutes utilizing the reactants at substantially a 1:1 molar ratio. While not limitative, the solvent is typically utilized in an amount of from about 2 to 10 cc of solvent per 1 g of reactants. A solvent is mandatory in the reaction.

A useful solvent used in the reaction is an alcohol (e.g. methyl alcohol or ethyl alcohol), acetonitrile or dimethyl acetamide. The reaction products are precipitated from the solution and so a pure product can be obtained merely by washing the products with the solvent.

The following Synthesis Examples illustrate the formation of various compounds within the scope of the present invention. Unless otherwise indicated, in all Synthesis Examples the pressure utilized was atmospheric pressure.

SYNTHESIS EXAMPLE 1

(Synthesis of 2-(2-acetyl)ethyl-benzothiazole)

To 50 g of o-aminothiophenol and 47 g of levulinic acid, 100 g of polyphosphoric acid were gradually added with stirring. Since the reaction was exothermic, the reaction system was cooled with water as necessary to keep the system temperature to 50° to 100° C.

The reaction mixture was then stirred for 3 hours on an oil bath at 170° to 180° C, cooled with water, and then about 1 liter of water was added thereto.

After neutralizing the mixture with sodium carbonate, it was extracted with 200 ml of benzene (the extraction was repeated twice), dried with sodium sulfate (anhydrous), and then distilled under reduced pressure (15 mmHg) to provide 42 g of 2-(2-acetyl)ethyl-benzothiazole having a boiling point of 145° to 148° C/1.5 mmHg.

SYNTHESIS EXAMPLE 2

(Synthesis of anhydro-2-[3-(phenylhydrazolo)butyl]-3-(3-sulfopropyl)benzothiazolium hydroxide)

8 g of 2-(2-acetyl)ethyl-benzothiazole and 5 g of propane sultone were reacted for 2 hours on an oil bath at 100° to 120° C.

After washing the resulting separated oily substance with diethyl ether, 50 ml of methyl alcohol was added to the oily substance and then 6.6 g of phenyl hydrazine was added, all at 20° to 25° C under stirring.

After the mixture was reacted for 2 hours at 20 to 25° C, the obtained crystals were filtered, washed with ethyl alcohol, and then dried to provide the objective compound having a melting point of 193° to 194° C (decomposition) with a yield of 7.0 g.

SYNTHESIS EXAMPLE 3

(Synthesis of anhydro-2-[3-(p-chlorophenylhydrazolo)butyl]-3-(3-sulfopropyl)benzothiazolium hydroxide)

11 g of 2-(2-acetyl)ethyl-benzothiazole and 6.6 g of propane sultone were reacted for 2 hours on an oil bath at 100° to 120° C.

The resulting separated oily substance was washed with ethyl alcohol and then 50 ml of ethyl alcohol was added, and further 9.2 g of p-chlorophenylhydrazine was added, all at 20° to 25° C with stirring.

After the mixture was reacted at 20° to 25° C for 3 hours, the obtained crystals were filtered, washed with ethyl alcohol and dried to provide the objective compound having a melting point of 209° to 211° C (decomposition) with a yield of 9.3 g.

A fogging agent is generally a reducing compound as well as a developing agent used for development of silver halide emulsions, and the reducing power of the reducing compounds can be shown by the half-wave potential measured by the polarographic method [see New Instrumental Method in Electrochemistry, by Delahay, Interscience Publishers, New York, N.Y., 1954; Polarography, by Kolthoff and Lingane, 2nd ed., Interscience Publishers, New York, N.Y., 1952; Analytical Chemistry, 30, 1576 (1958) by Adams.]

The fogging agent used in the invention can provide better effects where the cathodic half-wave potential thereof is more negative than − 250 mV (vs. SCE) under the standard conditions of development (i.e., at pH 11.5). However, there are often exceptional cases and so the fogging agent cannot be defined only by the polarograph half-wave potential.

In the direct positive light-sensitive materials of the invention, the heterocyclic quaternary salt compounds represented by formula (I), preferably formula (II) or (III), are more preferably incorporated into an internal image type silver halide emulsion layer, but they can be incorporated into another hydrophilic colloid layer, e.g., a hydrophilic colloid layer adjacent the internal image type silver halide emulsion layer. The hydrophilic colloid layer may have any function, e.g., it can be a light-sensitive layer, an intermediate layer, a filter layer, a protective layer, an antihalation layer, etc.

The amount of the quaternary salt compound in the layer is desirably such so that it can provide sufficient maximum density (e.g., not less than 2.0) when the internal image type emulsion is developed with a surface development type developing solution. The amount of the compound(s) can be practically varied according to the characteristics of silver halide emulsions, kinds of fogging agents and development conditions, and is about 5 mg to 1000 mg, preferably about 15 mg to about 700 mg, per mol of silver in the internal image type silver halide emulsion. Where the compounds are incorporated into the hydrophilic colloid layer adjacent to the emulsion layer, the amount of the compounds present in the former layer can be selected within the above range with respect to the amount of silver contained in an equal area of the silver halide layer.

The internal image type emulsion of this invention is a silver halide emulsion capable of forming a latent image predominantly inside the silver halide grains thereof and so is clearly distinguished from a silver halide emulsion capable of forming a latent image on the surface of the silver halide grains thereof. Such internal image emulsions are disclosed in U.S. Pat. No. 2,592,250 Davey et al and in much other literature. The internal image type silver halide emulsion can be clearly defined by the fact that the maximum density obtained by developing the emulsion with an internal type developing solution is higher than the maximum density obtained by developing the emulsion with a surface type developing solution. The internal image type silver halide emulsion employed in the invention is one which provides a maximum density (when the emulsion is coated on a transparent support and exposed for a fixed time between 0.01 to 1 second and is developed with the following developing solution A (internal type developer) for 3 minutes at 20° C) at least five times as great as the maximum density obtained by developing an identical sample of a coated emulsion exposed under identical conditions with the following developing solution B (surface type developer) for 4 minutes at 20° C, these densities being measured by conventional methods for the measurement of photographic density. While not to be construed as limitative, typically the emulsion thicknesses utilized in accordance with the present invention are on the order of from about 0.5 to about 10 $\mu$.

| Developing solution A | |
|---|---|
| Hydroquinone | 15 g |
| Monomethyl-p-aminophenol sesquisulfate | 15 g |
| Sodium sulfite | 50 g |
| Potassium bromide | 10 g |
| Sodium hydroxide | 25 g |
| Sodium thiosulfate | 20 g |
| Water to make 1 liter | |

| Developing solution B | |
|---|---|
| p-Oxyphenyl glycine | 10 g |
| Sodium carbonate | 100 g |
| Water to make 1 liter | |

As the internal image type silver halide emulsions employed in the invention, there can be used the emulsions as disclosed in British Pat. No. 1,027,146 and in U.S. Pat. Nos. 2,592,250, 3,206,313, 3,511,662, 3,447,927, 3,737,313 and 3,271,157. Reference can also be made to the following: U.S. Pat. Nos. 2,490,758, 2,497,875, 2,497,876, 2,497,917, 2,588,982, 2,604,400, 2,675,318 and 2,685,514.

The silver halide emulsions used in this invention can be made by any conventional process, for example, by a precipitation and ripening as is utilized to form silver halide grains having metal dopants or metal ions occluded therein, and the like. Typical processes include the well known single jet and double jet silver halide formation processes, and, in addition, processes utilizing controlled pAg and pH conditions. There, can also be utilized, if desired, processes comprising the utilization of ripening agents such as thiocyanates, thioethers and/or ammonia, processes involving increased flow rates, and the like.

The silver halide is not limited, and includes silver chloride, silver bromide, silver bromochloride, silver bromoiodide, mixtures thereof, etc.

The silver halide utilized in the present invention can have any crystal habit, for example (1,0,0), (1,1,1) and combinations thereof.

The grain size of the silver halide utilized in the present invention is not specifically limited, but typically such will be in the order of 0.2 to 4 microns.

It is most preferred that during precipitation of the silver halide grains the system be maintained at 30° to 90° C, at a pH of 3 to 11 and at a pAg of about 6 to 10.

In the direct positive photographic materials, various colloids can be employed as a binder. The colloids employed for this purpose include all hydrophilic colloids as are conventionally used in the photographic art such as gelatin, colloids such as albumin, polysaccharides, cellulose derivatives such as hydroxyethylcellulose, carboxymethylcellulose, cellulose sulfate, etc., synthetic resin (e.g. polyvinyl compounds including polyvinyl alcohol derivatives, for example, polyvinyl acetals, or acrylamide polymers), etc.

A hydrophobic colloid such as a dispersion of a polymerized vinyl compound can be employed together with the hydrophilic colloid to increase the dimensional stability of the photographic material, if desired. As specific examples of such compounds, there are water insoluble polymers such as polymers of alkyl acrylates, alkyl methacrylates, acrylic acid, sulfoalkyl acrylates or sulfoalkyl methacrylates.

Conventional supports may be used for the light-sensitive materials of this invention. The silver halide emulsions can be coated on one or both surfaces of the support. Typical supports include cellulose nitrate film, cellulose fatty acid ester films, for example cellulose acetate film, cellulose propionate film, polyvinyl acetate film, polystyrene film, polyethylene terephthalate film, other polyester films, paper, metals, ceramics, etc. Papers laminated with an $\alpha$-olefin polymer, particularly having 2 or more carbon atoms (e.g. polyethylene, polypropylene, an ethylene-butene copolymer, etc.) are also useful supports.

A photographic silver halide emulsion layer and the other hydrophilic colloid layers of the light-sensitive materials of this invention can be hardened with a conventional hardening agent, if desired. Examples of hardening agents include an aldehyde type hardening agent (e.g. formaldehyde or a mucohalogenic acid), an active halogen containing hardening agent, a dioxane derivative, an oxypolysaccharide (e.g. oxystarch), etc.

Into the photographic silver halide emulsion layer of this invention, other additives as are useful for photographic emulsions, e.g. a lubricating agent, a stabilizing agent, a sensitizing agent, a light-absorbing dye, a plasticizer, etc. can be added, if desired.

Further, a compound capable of releasing iodide ion (e.g., potassium iodide) can be incorporated into a silver halide emulsion of this invention, and the silver halide emulsion can be developed with a developing solution containing iodide ion to obtain desired images.

The light-sensitive materials of the invention may contain a surface active agent for various purposes. Depending upon the purpose, non-ionic, ionic and amphoteric surface active agents can be employed. As practical examples of surface active agents, there are polyoxyalkylene derivatives, amphoteric amino acids including sulfobetaines, etc. Useful surface active agents are disclosed, e.g., in U.S. Pat. Nos. 2,600,831, 2,271,622, 2,271,623, 2,275,727, 2,787,604, 2,816,902 and 2,739,891, and in Belgian Pat. No. 652,862.

The photographic emulsion for the light-sensitive materials of the invention can be spectrally sensitized to bluelight of a comparatively long wave length, green light, red light or infra-red rays. As spectral sensitizing dyes, cyanine dyes, merocyanine dyes, complex cyanine dyes, complex merocyanine dyes, holopolar cyanine dyes, stryl dyes, hemicyanine dyes, oxonol dyes, hemioxonol dyes, etc. can be employed. A dye belonging to cyanines may have a nitrogen-containing heterocyclic ring such as a pyrroline, oxazoline, thiazoline, pyrrole, oxazole, thiazole, selenazole, imidazole, pyridine or tetrazole ring as a basic nucleus. An aliphatic group such as an alkyl group, an alkenyl group, an alkylene group, a hydroxyalkyl group, a carboxyalkykl group, a sulfoalkyl group, an aminoalkyl group, an alkoxyalkyl group, a sulfohydroxyalkyl group or a sulfoalkoxyalkyl group may be attached as a substituent to the nitrogen atom of these nuclei.

There can be condensed to the nuclei, if desired, an unsubstituted aromatic ring (e.g., a benzene ring or naphthalene ring) or an aromatic ring substituted with a halogen atom, an alkyl group, an alkoxy group, a hydroxy group, a cyano group, a carboxy group, an alkoxycarbonyl group, an alkylamino group, dialkylamino group, an acylamino group, an acyl group, a phenyl group or a fluoroalkyl group, an alicyclic hydrocarbon ring (e.g. cyclohexene ring) or a heterocyclic ring (e.g., a quinoxaline ring, quinoline ring or pyridine ring).

The cyanine dyes may be symmetrical or asymmetrical, and the methine or polymethine chain thereof may be substituted with an alkyl group, a phenyl group, a substituted phenyl group (e.g., a carboxyphenyl group) or a heterocyclic nucleus (e.g., a furyl group, thienyl group, etc.). Further, a part of the methine chain may be linked with other atoms to form a 5- or 6-membered ring. The mercyanine dye may have an acidic nucleus such as a 2-thiaoxazolizine-dione nucleus, rhodanine nucleus, thiohydantoin nucleus, barbituric acid nucleus or pyrazolone nucleus together with the basic nucleus. To a nitrogen atom or carbon atom of the acidic nucleus, a substituent such as an alkyl group, an alkylene group, a phenyl group, a hydroxyalkyl group, a carboxyalkyl group, a sulfoalkyl group, an alkoxyalkyl group, an aminoalkyl group, an acylamino group of a heterocyclic nucleus (e.g., a furfuryl group) may be attached. These spectral sensitizing dyes can be employed alone or in combination. Many combinations of spectral sensitizing dyes are known for the purpose of supersensitization, and such can be employed in this invention.

Useful spectral sensitizing dyes are disclosed in U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632 and 2,503,776, in Japanese patent application (OPI) No. 76,525/73, and in Belgian Pat. No. 691,807.

A spectral sensitizing dye employed in the invention can be used in the same amount as that employed in conventional negative type silver halide emulsions. Particularly, the dye is preferably used in such an amount that the inherent sensitivity of silver halide emulsion is not substantially changed. The amount of the spectral sensitizing dye is generally about $1.0 \times 10^{-5}$ to about $5 \times 10^{-4}$ mol, more preferably about $4 \times 10^{-5}$ to $2 \times 10^{-4}$ mol, per one mol of silver halide.

The exact amount of spectral sensitizing dye(s) can be decided in a conventional manner as is well-known in the art, that is, by dividing an emulsion into several parts, adding the spectral sensitizing dye to the parts in differing amounts, and then measuring the spectral sensitivity of each part of the emulsion.

The spectral sensitizing dye(s) can be added directly to the emulsion or can be added to the emulsion in the form of a solution which is obtained by dissolving the spectral sensitizing dye(s) in water or a water miscible solvent (e.g. pyridine, methyl alcohol, ethyl alcohol, methyl cellosolve, acetone or mixture thereof), which may be further diluted with water. In dissolving the spectral sensitizing dye(s) in water or a solvent, ultrasonic waves can be applied, and, in addition, a method as disclosed in Japanese patent publication Nos. 8,231/70, 23,389/69, 27,555/69, and 22,948/69, German patent application (OPI) No. 1,947,935 and U.S. Pat. Nos. 3,485,634, 3,342,605 and 2,912,343 can be employed.

If necessary, the spectral sensitizing dyes can be added to the emulsion by dissolving each dye in a separate solvent, or by dissolving each dye in the same or different solvents and mixing the solutions.

The light-sensitive materials of this invention can include a color-image forming coupler or can be developed with a developing solution containing a color-image forming coupler. In order to incorporate the coupler into the silver halide emulsion of the invention, well-known methods can be applied, as disclosed in U.S. Pat. Nos. 1,055,153, 1,102,028, 2,186,849, 2,322,027 and 2,801,171. In this invention, a developing agent such as polyhydroxybenzenes, aminophenols or 3-pyrazolidones can be incorporated into the silver halide emulsion or a light-sensitive material of this invention. The photographic emulsion of this invention may be unhardened or may contain a tanning developing agent such as hydroquinone or catechol, if desired.

The photographic emulsion of this invention can be utilized in combination with a diffusion transfer color image providing substance capable of releasing a diffusible dye corresponding to the development of the silver halide to form a desired transfer image on a receiving material by development. Useful diffusion transfer color image providing substances are disclosed in U.S. Pat. Nos. 3,227,551, 3,227,554, 3,443,939, 3,443,940, 3,658,524, 3,698,897, 3,725,062, 3,728,113, and 3,751,406 in British Pat. Nos. 840,731, 904,364 and 1,038,331, in German patent application Nos. (OPI) 1,930,215, 2,214,381, 2,288,361, 2,242,762, 2,317,134, 2,402,900, 2,406,626 and 2,406,653, and in Japanese patent application (OPI) No. 114,424/74.

Image-wise exposure in accordance with the present invention can be conducted in a conventional manner using procedures well known to the art. The exact type of light source selected is not particularly limited, and includes, for example, sunlight, light from a tungsten lamp, light from a fluorescent lamp, light from a mercury lamp, light from a xenon lamp, light from an arc lamp, light from a carbon arc lamp, light from a xenon flash lamp, light from a cathode-ray tube flying spot and the like.

The exposure time is not particularly limited but typically will be on the order of about 1/1000 to about 1 second in a camera, as most cameras are capable of providing exposures on this order, though, of course, exposure times much less than 1/1000 second can be used, if desired, for example, $10^{-4}$ to $10^{-6}$ seconds exposure to a xenon flash lamp, a cathode-ray tube flying spot and the like.

If desired or necessary, color filters can be utilized to obtain image-wise exposure to any desired wavelength distribution.

Further, exposure can be by means of a laser or light generated from a fluorescent substance which is excited with electron beams, X-rays, $\gamma$-rays, $\alpha$-rays, etc.

To develop the light-sensitive materials of the invention, various developing agents can be used. That is, polyhydroxybenzenes (e.g., hydroquinone, 2-chlorohydroquinone, 2-methylhydroquinone, catechol or pyrogallol), aminophenols (e.g., p-aminophenol, N-methyl-p-aminophenol or 2,4-diaminophenol), 3-pyrazolidones (e.g., 1-phenyl-3-pyrazolidones, 4,4-dimethyl-1-phenyl-3-pyrazolidone, 5,5-dimethyl-1-phenyl-3-pyrazolidone), ascorbic acids, etc. can be employed alone or in combination. To obtain color dye images in the presence of color image forming couplers, an aromatic primary amino developing agent, preferably a p-phenylenediamine type developing agent, can be employed. As examples of the developing agents, there are 4-amino-3-methyl-N,N-diethylaniline hydrochloride, N,N-diethyl-p-phenylenediamine, 3-methyl-4-amino-N-ethyl-N-$\beta$-(methanesulfoamide)ethylaniline, 3-methyl-4-amino-N-ethyl-N-($\beta$-sulfoethyl)aniline, 3-ethoxy-4-amino-N-ethyl-N-($\beta$-sulfoethyl)aniline, 4-amino-N-ethyl-N-($\beta$-hydroxyethyl)aniline, etc. These developing agents may be incorporated into the light-sensitive materials or silver halide emulsion layer of this invention. The developing conditions utilized are conventional. Typical conditions are disclosed in U.S. Pat. Nos. 3,761,276 and 3,850,637.

The developing solution can contain, if desired, a preservative such as sodium sulfite, potassium sulfite, ascorbic acid, reductones (e.g. piperidinohexose-reductone), etc.

The light-sensitive materials of this invention can provide direct positive images when they are developed with a surface developing solution. Where the surface developing solution is employed, the development step is induced by the latent image or fogging nuclei on the surface of the silver halide grains. Though it is preferred that the developing solution not contain a silver halide solvent, the developing solution may contain a small amount of a silver halide solvent (e.g., a sulfite) so long as internal latent images are not substantially influenced until the silver halide grains are completely developed by the surface development centers.

The developing solution may contain, as an alkali agent and/or a buffering agent, sodium hydroxide, potassium hydroxide, sodium carbonate, potassium carbonate, sodium trisodium phosphate, sodium metaborate, etc, the amount of which is selected so that the pH of the developing solution is 10 to 13, preferably 11 to 12.5.

The quaternary salt type fogging agent of the invention can be incorporated into the developing solution. Where it is incorporated into the developing solution, the amount thereof is about 0.05 to about 5 g, preferably 0.1 to 1 g, per one liter of the developing solution.

The developing solution may contain a color development promoting agent such as benzyl alcohol. The developing solution may further profitably contain conventional antifoggants such as benzimidazoles (e.g., 5-nitrobenzimidazole) or benzotriazoles (e.g., benzotriazole or 5-methyl-benzotriazole) to lower the minimum density of the direct positive images.

The light-sensitive materials of this invention can be processed with a viscous developing soltuion, if desired. In a viscous developing solution, a hydrophilic polymer having a high molecular weight such as polyvinyl alcohol, hydroxyethyl cellulose, xanthane gum or sodium carboxymethyl cellulose can be added. These polymers are used in an amount so that the viscosity of the developing solution is not less than 100 poise, preferably 200 to 1,000 poise, at room temperature.

The developing temperature can be varied between 10° C to 40° C. The developing time can be varied between several seconds to 30 seconds, corresponding to the developing temperature, to obtain desirable sensitmetric properties.

Some examples of the invention are given below, but the invention should not be limited thereto them. In the following examples, unless otherwise indicated, all percentages are weight percentages.

EXAMPLE 1

An internal latent image type emulsion was prepared by the halogen conversion process as disclosed in U.S. Patent 2,592,250, as follows:

| Solution No. 1 (prepared at 50° C) | |
|---|---|
| Inactive gelatin | 20 g |
| Sodium chloride | 3.5 g |
| Water | 2,000 cc |

| Solution No. 2 (prepared at 40° C) | |
|---|---|
| Sodium chloride | 70 g |
| Water | 520 cc |

| Solution No. 3 (prepared at 40° C) | |
|---|---|
| Silver nitrate | 200 g |
| 25% Aqueous ammonia solution | 200 cc |
| Water | 400 cc |

| Solution No. 4 (prepared at 45° C) | |
|---|---|
| Potassium bromide | 160 g |
| Potassium iodide | 20 g |
| Water | 500 cc |

Solutions No. 2 and No. 3 were simultaneously added to solution No. 1 over a period of 90 seconds, the mixture was ripened for 1 minute at 45° C, solution No. 4 was added to the ripened mixture, and then the resulting mixture was ripened for 20 minutes at 45° C. Further, 235 g (dry amount) of inert gelatin was added and the system ripened for 15 minutes at 45° C, followed by setting the resulting mixture and then washing it with water to remove water soluble salts. Finally, 150 cc of a 10% aqueous solution of potassium chloride was added and then water added to make 4.5 liters.

The thus prepared emulsion was divided into 5 parts, and to each part 123 mg per one mol of silver of 1-(2,5-dichloro-4-methoxyphenyl)-3[3-(2,4-di-tertamyl-phenoxyacetoamide)phenylureido]-5-pyrazolone as a color dye-forming coupler was added. To each of three emulsions, 6 mg/mol silver of Compound 1, 2, or 3 was added, respectively, to give Emulsions A, B and C. To one of the others, 83 mg/mol of silver of 2-methyl-3-[3-(phenylhydrazono)propyl]benzothiazolium bromide as a nucleating agent or fogging agent (disclosed in U.S. Pat. No. 3,615,615) was added to give Emulsion D. To the last one, no nucleating agent was added to give Emulsion E. Emulsions A, B, C, D and E were coated on a cellulose triacetate film in an amount of 700 mg of silver per one square meter, respectively, to provide light-sensitive materials A to E. Light-sensitive materials A to E were then image-wise exposed (exposure time; 1/10 sec, maximum exposure amount; 200 Lux·sec, light source; tungsten lamp) and then developed with the following developer for 4 minutes at 20° C.

| Developing solution | |
|---|---|
| Benzyl alcohol | 6 ml |
| Potassium bromide | 1.0 g |
| Trisodium phosphate | 35 g |
| 5-Nitrobenzimidazole | 0.006 g |
| N-ethyl-N-β-hydroxyethyl-p-phenylenediamine | 20 g |
| Water to make 1 liter | |

(the pH of the solution was adjusted to 12.0 by adding 1 N sodium hydroxide.)

After development, each light-sensitive material was bleached and fixed to obtain reversal color images using the bath compositions set forth below. The maximum density, minimum density and gamma value of each material are shown in Table 1.

| Bleach Solution | |
|---|---|
| Potassium ferricyanide | 50 g |
| Potassium bromide | 20 g |
| Water to make | 1 liter |

pH: 6.5–7.0

Bleaching was conducted for 10 minutes at 20° C

| Fixing Solution | |
|---|---|
| Sodium thiosulfate | 153 g |
| Sodium sulfite | 15 g |
| Glacial acetic acid | 13.5 cc |
| Boric acid | 7.5 g |
| Potash alum | 15.0 g |
| Water to make | 1 liter |

Fixing was conducted at 20° C for 10 minutes.

Table 1

| Light-sensitive material | $D_{max}$ | $D_{min}$ | Gamma |
|---|---|---|---|
| A | 1.83 | 0.12 | 1.82 |
| B | 1.81 | 0.12 | 1.90 |
| C | 1.92 | 0.10 | 1.91 |
| D | 1.85 | 0.15 | 1.77 |
| E | 0.09 | 0.07 | * |

* Too low to measure.

As is apparent from the results in Table 1, where the quaternary salt fogging agent of the invention is employed, the desired nuclei formation can be carried out and better reversal images can be obtained by using a smaller amount of the fogging agent of this invention than that of well-known quaternary salt fogging agents.

EXAMPLE 2

The same internal image type silver halide emulsion as in Example 1 was spectrally sensitized to green light by adding anhydro-5,5'-diphenyl-9-ethyl-3,3'-di-(3-sulfopropyl)oxacarbocyanine hydroxide to the emulsion (the amount of oxacarbocyanine dye incorporated in the emulsion was $1 \times 10^{-4}$ mol/mol Ag halide). The weight ratio of Ag/coupler was 6. As with Emulsions A, B and C in Example 1, the coupler and the fogging agent were added to each of the three-divided emulsions which was then coated on a support to provide light-sensitive materials F, G and H, respectively. The light-sensitive materials were image-wise exposed and developed in the same manner as in Example 1 to obtain reversal color images. The photographic properties obtained in the each light-sensitive material are shown in Table 2.

Table 2

| Light-sensitive material | $D_{max}$ | $D_{min}$ | Gamma | $S_{rel}$ |
|---|---|---|---|---|
| F | 1.84 | 0.12 | 1.89 | 145 |
| G | 1.82 | 0.13 | 1.86 | 136 |
| H | 1.52 | 0.11 | 1.75 | 100 |

In Table 2, $S_{rel}$ is the relative sensitivity which is the relative value of the reciprocal of the exposure amount providing a density one-half of the sum of the maximum transmission density and the minimum transmission density.

As is apparent from Table 2, light-sensitive material F containing Compound 1 of this invention and light-sensitive material G containing Compound 2 of this invention provided higher sensitivity, maximum density and gamma than those of light-sensitive material H containing 2-methyl-3-(hydrazonoalkyl)benzothiazolium salt, a well-known fogging agent. These results are based on the facts that a small amount of the quaternary salt fogging agent of this invention has a sufficient fogging effect and does not affect the spectral sensitization.

While the invention has been described in detail and with reference to specific embodiments thereof, it will be apparent to one skilled in the art that various changes and modifications can be made therein without departing from the spirit and scope thereof.

What is claimed is:

1. A direct positive silver halide light-sensitive material capable of forming direct positive images comprising a support having coated thereon at least one internal image silver halide emulsion layer, wherein said light-sensitive material contains at least one hydrophilic colloid layer containing heterocyclic quaternary salt compound represented by formula (I) in an amount of about 5mg to about 1000mg per 1 mol of silver halide sufficient so that said compound acts as a fogging agent in the silver halide photographic emulsion

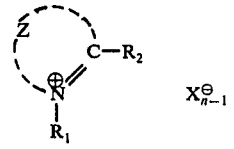

(I)

wherein Z is an atomic group necessary for completing a 5- or 6-membered heterocyclic nucleus selected from the group consisting of a thiazole nucleus, a benzothiazole nucleus, a naphthothiazole nucleus, a selenazole nucleus, a benzoselenazole nucleus, a naphthoselenozole nucleus, an oxazole nucleus, a benzoxazole nucleus, a naphthoxazole nucleus, a benzimidazole nucleus, a pyridine nucleus, a quinoline nucleus and an indolenine nucleus, $R_1$ is an aliphatic group, having 1 to 8 carbon atoms, which aliphatic group is selected from the group consisting of an unsubstituted alkyl group, a sulfo substituted alkyl group, a sulfoalkoxyalkyl group, a hydroxysulfoalkyl group, a carboxyalkyl group, a hydroxyalkyl group, an alkoxyalkyl group, an acyloxyalkyl group, a dialkylaminoalkyl group, a sulfatoalkyl group, an aralkyl group, and a vinylmethyl group, $R_2$ is a hydrazonoalkyl group having 1 to 8 carbon atoms in the alkyl moiety thereof, $X\ominus$ is an anion, and $n$ is 1 or 2, when $n$ is 1 the compound forms an intermolecular salt.

2. The material of claim 1, wherein said heterocyclic quaternary salt compound is represented by formula (II):

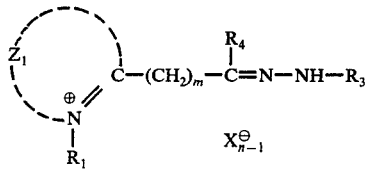

wherein $Z_1$ is an atomic group necessary for completing a benzothiazole nucleus, a benzoselenazole nucleus, a benzoxazole nucleus or a pyridine nucleus, $R_3$ is an aryl group or an aralkyl group, $R_4$ is a alkyl group having up to 4 carbon atoms or an aryl group, $m$ is 1 to 4 and $R_1$, $X\ominus$ and $n$ each have the same meaning as in formula (I).

3. The material of claim 2, wherein said aryl group for $R_3$ is selected from a phenyl group or a naphthyl group either of which is substituted with a halogen atom, an alkyl group having up to 4 carbon atoms, an alkoxy group having up to 4 carbon atoms, a hydroxy group, a sulfo group or a carboxy group, wherein said aralkyl group for $R_3$ is a benzyl group, and wherein said aryl group for $R_4$ is a phenyl group, a p-tolyl group, a p-methoxyphenyl group, a 3,5-dichlorophenyl group or an o-carboxyphenyl group.

4. The material as claimed in claim 2, wherein said heterocyclic quaternary salt compound is represented by the formula (III):

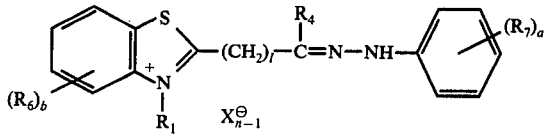

wherein $R_6$ is a halogen atom, an alkyl group having 1 to 4 carbon atoms, an alkoxy group having 1 to 4 carbon atoms, a hydroxy group, a carboxy group or an aryl group, $R_7$ is an alkyl group having 1 to 4 carbon atoms, a halogen atom, an alkoxy group having 1 to 4 carbon atoms, a hydroxy group, a sulfo group or a carboxy group, $a$ and $b$ are each 0, 1, 2 or 3, $l$ is 2 or 3 and $R_1$, $R_4$, $X\ominus$ and $n$ each has the same meaning as in formula (II), with the proviso that when $a$ is 2 or 3, 2 or 3 of $R_7$ may be same or different and $b$ is 2 or 3, 2 or 3 of $R_6$ may be same or different.

5. The material of claim 2, wherein the amount of the heterocyclic quaternary salt compound is about 15 mg to 700 mg per 1 mol of silver halide.

6. The material of claim 4 wherein the amount of the heterocyclic quaternary salt compound is about 15 mg to 700 mg per 1 mol of silver halide.

7. The material as claimed in claim 1, wherein said heterocyclic quaternary salt compound is in said internal image silver halide emulsion layer.

8. The material as claimed in claim 1, wherein said hydrophilic colloid layer containing said heterocyclic quaternary salt compound is adjacent to said internal image silver halide emulsion layer or layers.

9. The material of claim 1 wherein the alkyl group of the substituted alkyl group has 1 to 4 carbon atoms and the alkoxy moiety of the alkoxy alkyl group has 1 to 4 carbon atoms.

10. The material of claim 1 wherein $R_1$ is methyl group, ethyl group, propyl group, butyl group, β-sulfoethyl group, γ-sulfopropyl group, γ-sulfobutyl group, δ-sulfobutyl group, sulfoethoxyethyl group, sulfopropoxyethoxyethyl group, 2-hydroxypropyl group, 3-sulfopropyl group, β-carboxyethyl group, ω-carboxybutyl group, carboxymethyl group, β-hydroxyethyl group, γ-hydroxypropyl group, β-methoxyethyl group, γ-methoxypropyl group, hydroxymethoxymethyl group, 2-hydroxyethoxymethyl group, 2-(2-hydroxyethoxy) ethyl group, 2-(acetoxyethoxy) ethyl group, acetoxymethoxymethyl group, β-acetoxyethyl group, ω-propionyloxybutyl group, dimethylaminoethyl group, diethylaminopropyl group, β-sulfatoethyl group, ω-sulfatobutyl group, benzyl group, phenethyl group, or p-sulfobenzyl group.

11. The material of claim 1 wherein the alkyl moiety of said dialkylaminoalkyl group contains 1 to 4 carbon atoms.

* * * * *